United States Patent [19]

Shibata et al.

[11] Patent Number: 5,043,771

[45] Date of Patent: Aug. 27, 1991

[54] IMAGE FORMING APPARATUS HAVING A CONTROLLER FOR CONTROLLING THE REGISTRATION ROLLERS

[75] Inventors: Akihiro Shibata; Shunji Matsuo, both of Tokyo, Japan

[73] Assignee: Konica Corporation, Tokyo, Japan

[21] Appl. No.: 355,485

[22] Filed: May 24, 1989

[30] Foreign Application Priority Data

May 24, 1988 [JP] Japan ..... 63-128088
May 24, 1988 [JP] Japan ..... 63-128089

[51] Int. Cl.[5] ..... G03G 21/00

[52] U.S. Cl. ..... 355/317; 271/217; 355/208; 355/316

[58] Field of Search ..... 271/265, 270; 355/316, 355/317, 202, 203, 208, 204

[56] References Cited

U.S. PATENT DOCUMENTS 3,781,004 12/1973 Buddendeck et al. ..... 355/317 X
4,523,832 6/1985 Strutt et al. ..... 355/317 X
4,541,711 9/1985 Takahashi ..... 355/317 X
4,597,660 7/1986 Leng et al. ..... 355/317
4,708,456 11/1987 Shibata et al. ..... 355/317 X
4,835,567 5/1989 Ogata ..... 355/319 X

FOREIGN PATENT DOCUMENTS 0014159 1/1983 Japan ..... 355/317
0208065 9/1987 Japan ..... 355/317

*Primary Examiner*—A. T. Grimley
*Assistant Examiner*—Robert Beatty
*Attorney, Agent, or Firm*—Finnegan, Henderson, Farabow, Garrett, and Dunner

[57] ABSTRACT

An image forming apparatus including a double feeding preventing mechanism which is arranged at an outlet side of a sheet feeding unit so that only one transfer material is fed, a sheet-feed controller which is stopped immediately after a leading end of the transfer material fed from the sheet feeding unit abuts against a nip portion between a pair of registration rollers, and a conveying controller for controlling rotation of the registration rollers such that the registration rollers are rotated after a sheet feeding operation is stopped so as to convey the transfer material to a predetermined position at low speed and are then rotated to convey the transfer material from the predetermined position to a transfer position in synchronism with a latent image formation timing.

9 Claims, 15 Drawing Sheets

108 : LASER BEAM SCANNER

IMAGE FORMING APPARATUS HAVING A CONTROLLER FOR CONTROLLING THE REGISTRATION ROLLERS

BACKGROUND OF THE INVENTION

1. Field of the Invention

The present invention relates to an image forming apparatus in which a magnetic latent image, an electrostatic latent image, or the like, is formed on, e.g., an image forming body, is developed with a toner; the obtained toner image is transferred onto a conveyed transfer material, and the transferred toner image is fixed to form a visible image. More particularly, the present invention relates to improvement of feeding and conveying mechanisms of the transfer material.

2. Description of the Prior Art

In a conventional image forming apparatus, in order to transfer a toner image formed on an image forming body at a proper timing, a transfer material (or transfer sheet) conveyed from a sheet feed cassette is brought into contact with and stopped at registration rollers in advance, and the registration rollers are driven in synchronism with a scan start operation of an optical system for reading original information, thereby conveying the transfer sheet to a transfer region.

Along with the advance of recent copying techniques, it is desired to more accurately reproduce an original image on a transfer sheet. For this purpose, the following problems are posed for the prior art in which the transfer sheet is conveyed to the transfer region in synchronism with an image formation timing under the control of the registration rollers.

(1) The position of the leading end of the transfer sheet stopped at the registration rollers is indefinite, and an offset of timing occurs more or less in every transfer.

(2) When the registration rollers are driven in response to a scan start signal to convey the transfer sheet, since the rollers often do not satisfactorily catch the transfer sheet, the transfer sheet slips. As a result, a conveying operation is delayed or the transfer sheet is bent.

For example, Japanese Patent Laid-Open (Kokai) No. 62-208065 has been proposed. In this prior art, a transfer sheet fed from a sheet feed cassette is conveyed by registration rollers to a first position in front of the registration rollers. At the first position, the conveying operation of the transfer sheet is decelerated to, e.g., a low speed ¼ of that in a sheet feeding/conveying mode by decelerating a drive motor. Subsequently, the transfer sheet is conveyed to and stopped at a second position. Thereafter, the transfer sheet is conveyed from the second position as a reference point to a transfer region of an image forming apparatus in synchronism with an image formation timing. A toner image formed on an image forming body is transferred to the conveyed transfer sheet. The detailed content will be briefly described with reference to FIGS. 1 and 2. More specifically, a transfer sheet P stacked on a cassette 6 is fed and conveyed by a transfer sheet pickup roller 7, and is then caught and conveyed by registration rollers 8. The transfer sheet P then reaches a first position A, and its leading end is detected by a first sensor 11*a*. The detection signal from the sensor 11*a* is supplied to a CPU 60. The CPU 60 controls a motor 9 through a motor controller 12, thus adjusting a rotational speed of the registration rollers 8. For example, the rotational speed of the registration rollers 8 is decreased to ½ of that in a sheet feeding/conveying mode. The transfer sheet P is decelerated to a low speed, and reaches a second position B. When the leading end of the transfer sheet is detected by a second sensor 11*b*, the transfer sheet is stopped under the control of the CPU 60 and the like. At this time, an image forming body 1 undergoes a charging operation by a charger 3, a write operation by a laser beam L, a developing operation by a developing unit 4, thus forming a toner image on the image forming body. The registration rollers 8 are rotated in synchronism with the image formation timing, and the transfer sheet P is conveyed to a transfer region in correspondence with a peripheral velocity of the image forming body 1. Thus, the toner image formed on the image forming body 1 is transferred onto the transfer sheet P by a transfer electrode 5. After the transfer operation, residual toner on the image forming body 1 is removed by a cleaning device 2.

FIG. 2 is a timing chart showing feeding and conveying timings of the transfer sheet P in the image forming apparatus shown in FIG. 1. A VSREQ signal represents an image output permission signal, a VSYNC signal represents an image output sync signal, a VIDEO signal represents an image signal, $T_O$ represents a period after the image output sync signal is output until the image signal is output, and $T_R$ represents a period after the image output sync signal is output until the registration rollers 8 are driven. As can be seen from this chart, the transfer sheet P is conveyed to the first position A at high speed by the pickup roller 7 and the registration rollers 8. When the leading end of the transfer sheet is detected by the first sensor 11*a*, the high-speed conveying mode is switched to a low-speed conveying mode at a speed about ¼ of that in the high-speed conveying mode, and the transfer sheet is conveyed to the position B. When the leading end of the transfer sheet is detected by the second sensor 11*b*, the transfer sheet is stopped.

The registration rollers 8 are rotated again in synchronism with the VSYNC signal, so that the transfer sheet P is conveyed to the transfer region.

According to Japanese Patent Laid-Open (Kokai) No. 62-208065, as shown in FIG. 1, the transfer sheet P is satisfactorily caught by the registration rollers 8, and is then conveyed to the second position B at low speed. As a result, a slip of the transfer sheet P and a variation in the leading end position of the transfer sheet at the second position B can be eliminated.

However, in the prior art technique, a conveying speed must be immediately decreased to about ¼ during a conveying operation by the registration rollers 8. Such an operation causes a speed change error in a conventional speed change device, and the low-speed conveying operation between the first and second positions A and B becomes very unstable. When the speed change operation is abruptly performed, the speed change device may be damaged. Since a plurality of sensors are used after the registration rollers 8, this makes the apparatus complex, and a traveling distance to the transfer region is prolonged. As a result, the apparatus becomes bulky, thus increasing cost.

In order to precisely convey a transfer sheet in synchronism with the image formation timing, the transfer sheet must be subjected to necessary countermeasures for preventing, e.g., double feeding or skew before it reaches the registration rollers 8. Since the prior art does not take such countermeasures, satisfactory precision cannot be assured although conveying control of the transfer sheet P is performed using a plurality of sensors after the registration rollers 8.

The problem of misregistration of the leading end position of the transfer sheet is particularly important in a color image forming apparatus. In this apparatus, an original is scanned to obtain color recording signals of yellow Y, magenta M, cyan Cy, black Bk, and the like, and the recording signals are written on an image forming body through a laser beam in units of colors to form an electrostatic latent image. The latent image is developed by a developing agent including a color toner to form a color toner image, and the color toner image is transferred onto a transfer sheet. This process is repeated. The transfer sheet is then separated from a transfer drum (image forming body) and is subjected to fixing to form a color image.

SUMMARY OF THE INVENTION

The present invention has been made in consideration of the above situation, and has as its object to provide an image forming apparatus which conveys a transfer material to a transfer region by an improved sheet feeding-/conveying means, and can obtain a high-quality copied image on the transfer material.

In order to achieve the above object, there is provided an image forming apparatus having image forming means for forming an image on a transfer material on the basis of image information from an original and registration means for conveying the transfer material to the image forming means at a predetermined timing, comprising: first sheet feeding means including double feeding preventing means for feeding and conveying only one transfer material from a sheet feeding unit, and skew preventing means for registering a leading end of the fed and conveyed transfer material in a direction perpendicular to the conveying direction; and second sheet feeding means including means for low-speed conveying the transfer material prevented from being skewed to a predetermined position using the registration means, and means for conveying the low-speed conveyed transfer material from the predetermined position to a transfer region of the image forming apparatus in synchronism with an image formation timing.

The characteristic feature of the present invention is the first paper feeding means including the double feeding preventing means for preventing double feeding of the transfer material fed and conveyed from the sheet feeding unit and reliably conveying only one transfer material, and the skew preventing means for registering the leading end of the transfer material during a conveying operation so as to correctly convey the transfer material with respect to the conveying direction. As the principal feature of the present invention, after the transfer material fed and conveyed one by one by the first sheet feeding means is temporarily stopped while its leading end is registered, the transfer material is conveyed by registration rollers of the second sheet feeding means to the predetermined position at a specific low speed.

When the transfer material is conveyed to the predetermined position, its leading end is detected by a first sensor, and the transfer material is stopped at the predetermined position in response to the detection signal from the first sensor. Thereafter, the transfer material is conveyed to the transfer region in response to a scan start signal of an original image, and a toner image on an image forming body is transferred onto the transfer material. Since the transfer material is conveyed from the registration rollers of the second sheet feeding means to the predetermined position at low speed, it can be stopped at the predetermined position in response to a stop signal with almost no influence of inertia. When the transfer material is conveyed to the transfer region in response to the next scan start signal, a toner image can be transferred while being satisfactorily matched with the image formation timing.

As described above, since the transfer material is fed and conveyed using the first and second sheet feeding means of the present invention, multi-stage control using a plurality of sensors after the registration rollers need not be performed, and a feeding/conveying function of the transfer material can be more precisely realized than in the prior art.

DETAILED DESCRIPTION OF THE PREFERRED EMBODIMENTS

The present invention will now be described with reference to the accompanying drawings.

Figure 3:
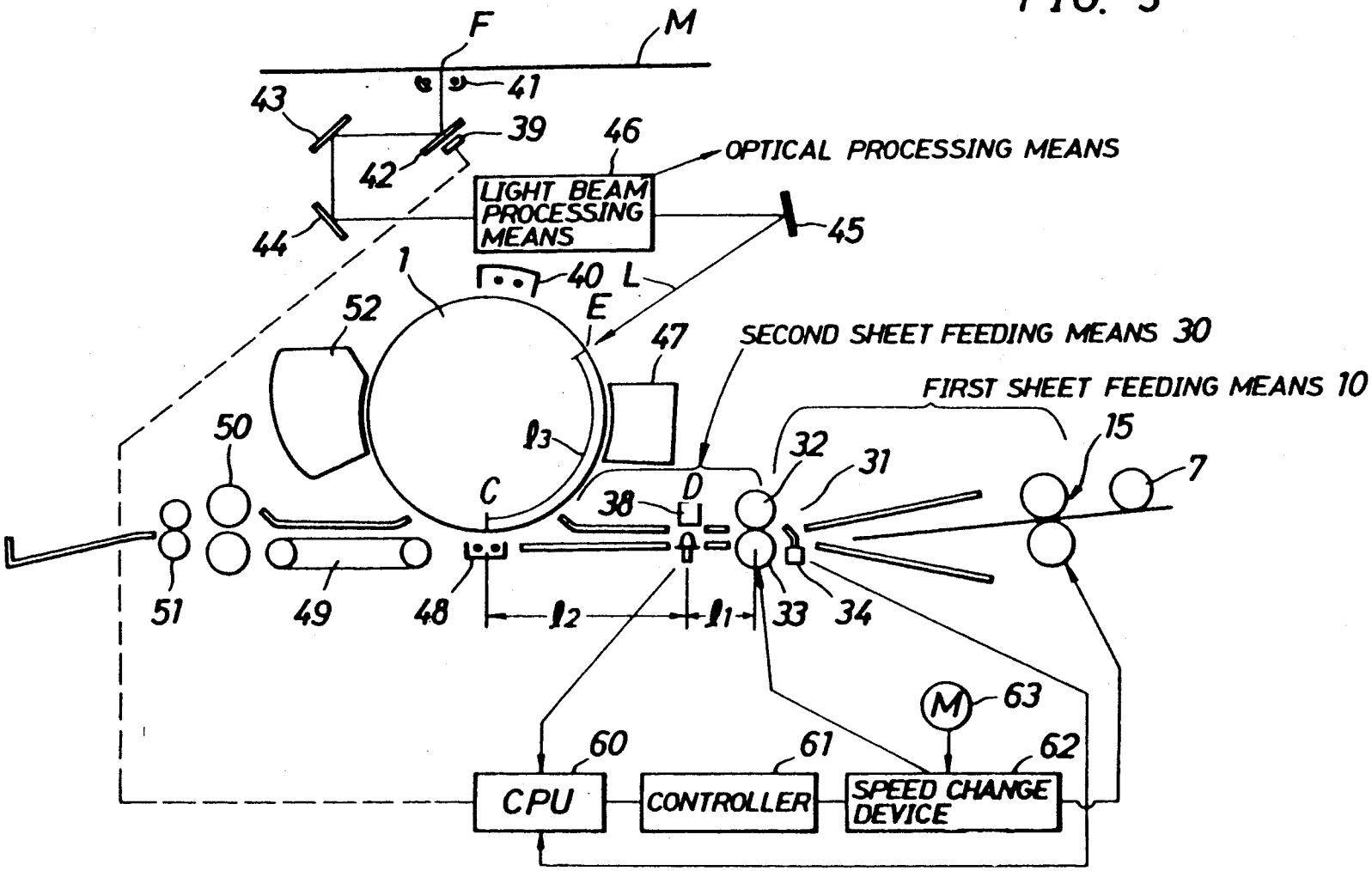
FIG. 3 is a schematic view showing an arrangement of an embodiment of an image forming apparatus according to the present invention.

FIG. 3 is a schematic view showing an arrangement of an embodiment of an image forming apparatus according to the present invention. A black-and-white image forming apparatus is exemplified in FIG. 3.

The surface of an image forming body 1 is uniformly charged by a charger 40. Exposure light L obtained by scanning an original M through a light source 41, reflection mirrors 42 to 45, and an optical processing means 46 is radiated on the surface of the image forming body 1, thus forming an electrostatic latent image thereon. The exposure light L may be analog image exposure light focused by the optical processing means 46 comprising a lens system or may be a laser beam modulated by a recording signal obtained by photoelectrically converting and A/D-converting a light beam and performing signal processing of digital data. The latent image is developed by a developing unit 47 to form a toner image. The toner image is transferred onto a transfer sheet P which is conveyed to a transfer region D through the first and second sheet feeding means upon operation of a transfer electrode 48. The transfer sheet with the toner image is conveyed to a fixing device 50 by a conveyor belt 49 to be heated and fixed. The transfer sheet is then exhausted by sheet exhaust rollers 51. The image forming body 1 after the transfer operation is cleaned by a cleaning means 52 to prepare for the next image formation.

Figure 6:
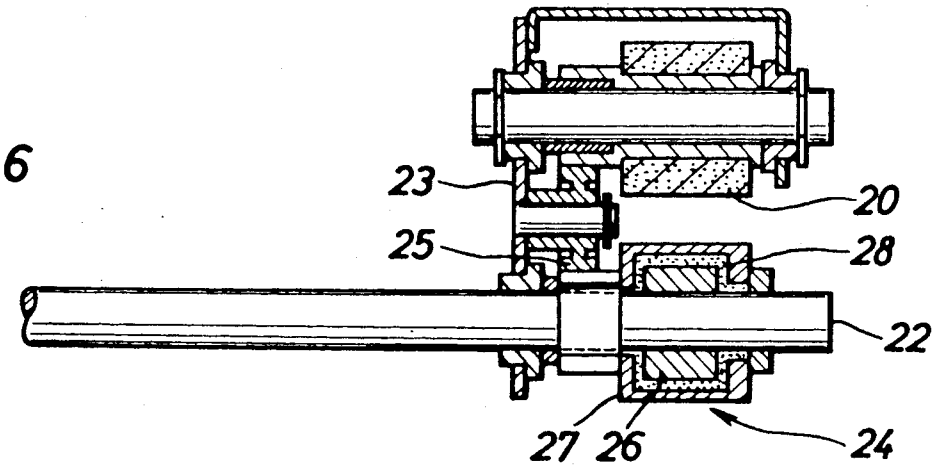
FIG. 6 is a partial sectional view of a sheet feeding unit of the sheet feeding/conveying mechanism shown in FIG. 5.

A sheet feeding/conveying operation of the transfer sheet P will be described below with reference to FIGS. 4 to 6.

Figure 4:
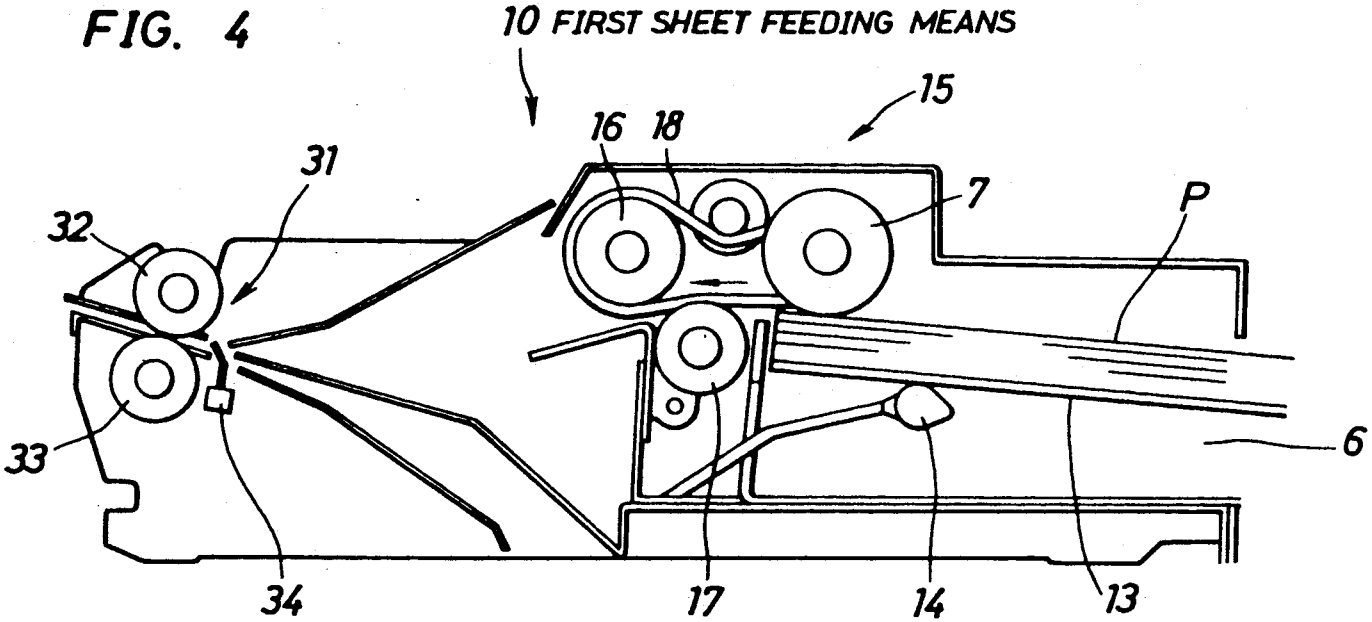
FIG. 4 is a sectional view showing an embodiment of a sheet feeding/conveying mechanism of a transfer sheet in the image forming apparatus of the present invention.

FIG. 4 shows in detail the first sheet feeding means of the image forming apparatus shown in FIG. 3. Transfer materials P stacked on a bottom plate 13 in a sheet feed cassette 6 are urged against a pickup roller 7 by a bottom plate push-up lever 14. When the pickup roller 7 is rotated in response to a transfer sheet pickup signal, each transfer sheet P is handled by a lower stationary roller 17 and a handling belt 18 which is looped between a pulley (not shown) arranged coaxially with the pickup roller 7 and an upper roller 16 and is pivoted by these rollers The transfer sheets P are fed and conveyed to the next process one by one. When only one transfer sheet is fed by the pickup roller 7, it is fed and conveyed while being drawn by a frictional surface of the handling belt 18 and sliding on the surface of the lower roller 17. When a plurality of transfer sheets P are fed at a time, the underlying transfer sheet is stopped by the friction on the surface of the lower roller 17, and only the overlying transfer sheet is fed and conveyed while being drawn by the frictional surface of the handling belt 18 and sliding on the surface of the underlying transfer sheet. Each transfer sheet P fed as described above is conveyed at a sheet feeding speed of, e.g., 160 mm/sec to registration rollers 31. Before the transfer sheet reaches the registration rollers 31, its leading end is detected by a first sensor 34, and a drive source of the pickup roller 7 is stopped on the basis of the detection signal from the sensor. In this case, the transfer sheet P abuts against a nip portion between the registration rollers 31. Since the stop operation of the drive source is slightly delayed (by about 0.2 to 0.7 sec), a loop is formed. By a restoration force of the loop, the leading end of the transfer sheet is fitted in the nip portion, and is registered, thus correcting skew.

A double feeding preventing means 15 in the first sheet feeding means 10 described above has room for improvement since the double feeding prevention effect is obtained when a coefficient of friction among the transfer sheet P, the handling belt 18, and the lower roller 17 is set to fall within a specific range.

Another embodiment of the improved first sheet feeding means will be described below with reference to FIGS. 5 and 6. The same reference numerals in FIGS. 5 and 6 denote the same parts as in FIG. 1. In FIGS. 5 and 6, a double feeding preventing means 15 comprises a driving roller 19, a handling roller 20, an idler 25 cooperating with the handling roller 20 through a gear, and a limiter 24 cooperating with the idler 25 through a gear. The rotating shafts of the handling roller 20 and the idler 25 are supported by a support member 23 axially and rotatably supported on a drive shaft 22 of the limiter 24. Since the lower end of the support member 23 is coupled to the other end of a coil spring 21 whose one end is fixed to a main body, the support member 23 is biased to be rotated counterclockwise about the driver shaft 22 of the limiter 24. For this reason, the handling roller 20 is pressed against the driving roller 19.

Figure 1:
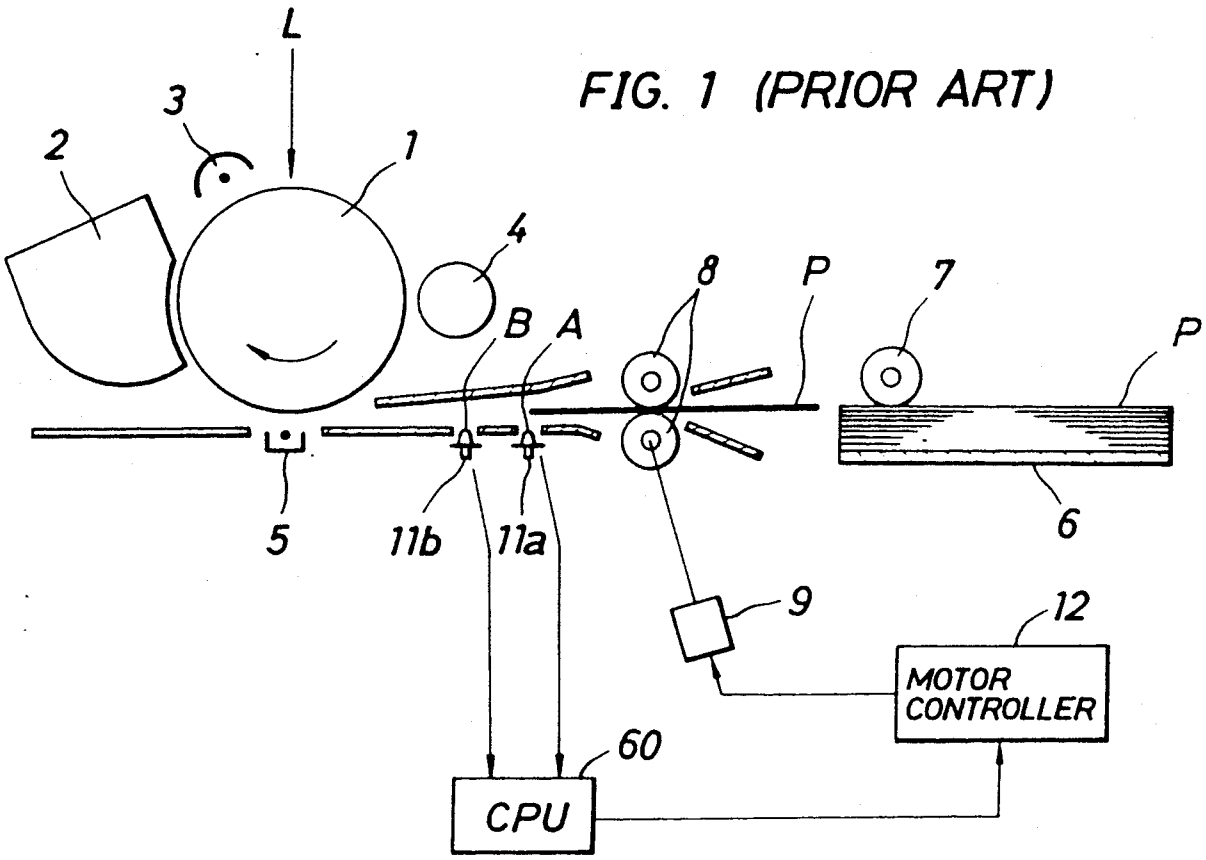
FIG. 1 (PRIOR ART)
FIG. 1 is a schematic view of a sheet feeding/conveying mechanism of a transfer sheet in a conventional image forming apparatus.
Figure 2:
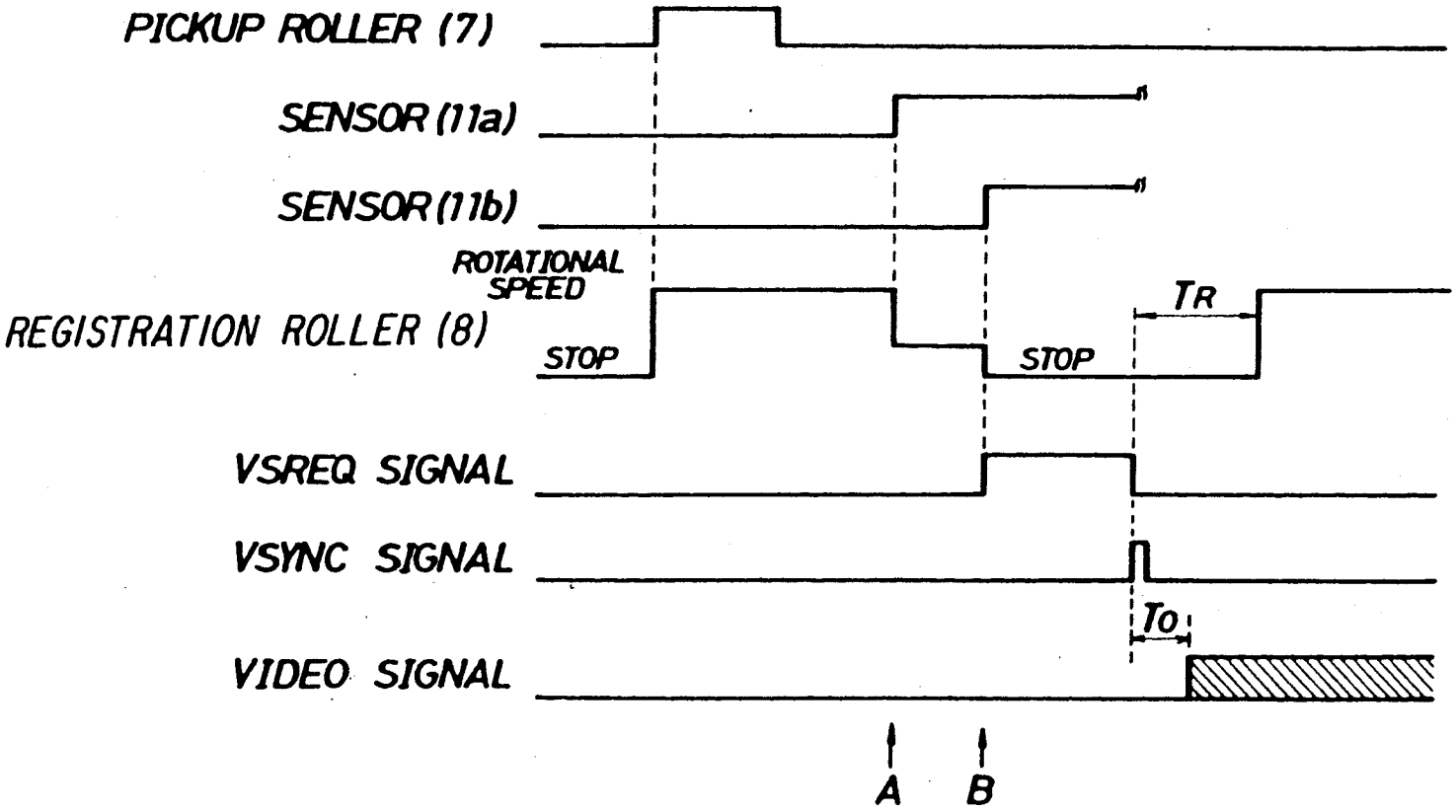
FIG. 2 (PRIOR ART)
FIG. 2 is a timing chart for explaining an operation of the sheet feeding/conveying mechanism shown in FIG. 1.
Figure 7:
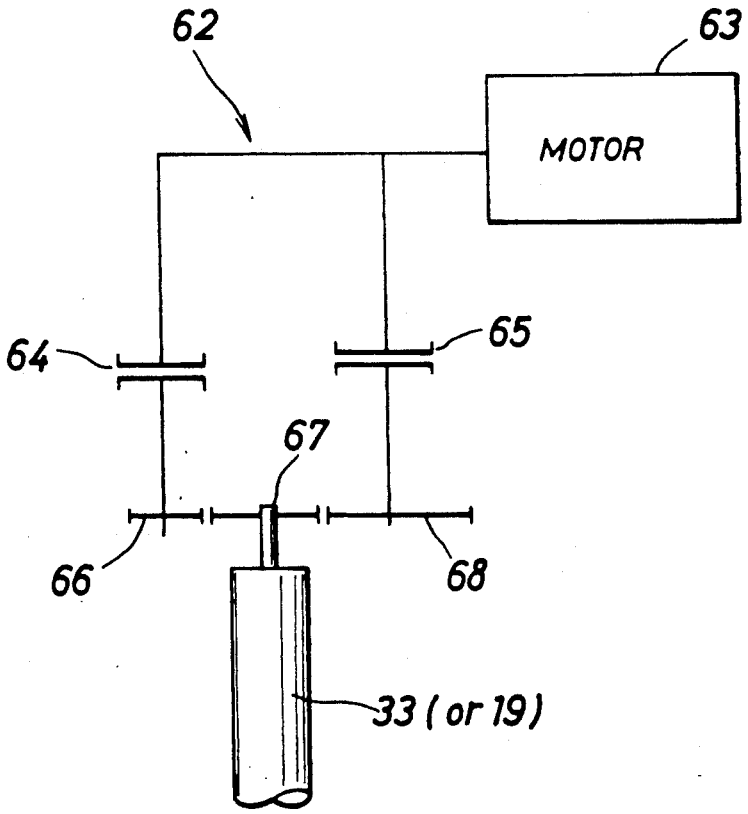
FIG. 7 is a view showing a detailed arrangement of a speed change device in the sheet feeding/conveying mechanism shown in FIG. 3.

The limiter 24 comprises a magnetic inner roller 26 integrated with the drive shaft 22, a magnetic outer roller 27 fitted on the inner roller 26 and cooperating with the idler 25 through a gear, and a magnetic powder 28 interposed between the inner and outer rollers to magnetically transmit the rotating force of the drive shaft 22 to the outer roller 27. Note that the driver shaft 22 is rotated in a direction to rotate the handling roller in a reverse direction (in a direction to return the transfer sheet P). Note that drive, stop, and speed change operations of the pickup roller 7 and the double feeding preventing means of the first sheet feeding means 10, the registration rollers 31 of the second sheet feeding means 30, and the like are performed under the control of the CPU 60, a controller 61, a speed change device 62, (motor 63), and the like, as shown in FIG. 3. The speed change device 62 may comprise a pulse motor which changes a speed by changing a resonance frequency as shown in FIG. 1 of Japanese Patent Laid-Open (Kokai) No. 62-208065 or may be a speed change gear clutch as shown in FIG. 7 in an embodiment (to be described later).

With the above structure, the transfer sheet P which is fed and conveyed by the pickup roller 7 of the first sheet feeding means 10 is fed into the double feeding preventing means 15 at relatively high speed under the control of the controller 61. When only one transfer sheet is fed, a relatively large torque is applied to the handling roller 20 shown in FIGS. 5 and 6, and is transmitted to the outer roller 27 of the limiter 24 through the idler 25. The roller 27 overcomes a magnetic constraint force of the inner roller 26 which is rotated in the reverse direction, and is operated as a driven roller of the driving roller 19 to convey the transfer sheet to the next process in cooperation with the driving roller 19. When transfer sheets P are double-fed, since a coefficient of friction between the transfer sheets is small, a relatively small torque is applied to the handling roller 20, and is transmitted to the outer roller 27 of the limiter 24 through the idler 25. However, the roller 27 cannot overcome the magnetic constraint force of the inner roller 26 which is rotated in the reverse direction, and is also rotated in the reverse direction. Therefore, the handling roller 20 which cooperates with the outer roller 27 through the gear is also rotated in the reverse direction, and the underlying transfer sheet is pushed back to the sheet feeding cassette 6. As a result, only the upper transfer sheet is fed and conveyed to the next process.

The pickup roller 7 and the double feeding preventing means 15 of the first sheet feeding means have been described. As the double feeding means, a separation pawl attached to the sheet feed cassette may be used together The only one transfer sheet P fed by the driving roller 19 of the double feeding preventing means 15 is fed to the registration rollers 31 which are in a still state and consist of driven and driving rollers 32 and 33. Before the transfer sheet reaches the registration rollers, its leading end is detected by the first sensor 34, and the first sheet feeding means 10 is stopped by the obtained detection signal through the CPU 60 and the controller 61. The transfer sheet P is brought into contact with the registration rollers 31 and forms a loop since the first sheet feeding means 10 is operated for a while by inertia after it receives the detection signal. In the same manner as in the above embodiment, the leading end of the transfer sheet P is fitted in and caught by the nip portion between the registration rollers 31 by a restoration force of the loop, and is registered in a direction perpendicular to the conveying direction of the transfer sheet P, thus preventing subsequent skew.

The second sheet feeding means 30 will be described below.

The transfer sheet P caught by the registration rollers 31 and whose leading end is registered is low-speed conveyed to a predetermined position D by a length $l_1$ under the control of the CPU 60 and the like after the lapse of a predetermined period of time ($T_1$) from the time at which the transfer sheet is detected by the first sensor 34 shown in FIG. 3. The transfer sheet is then detected by a second sensor 38, and is stopped under the control of the CPU 60 and the like. Thereafter, the registration rollers 31 are again driven in response to a sensor 39 for detecting an optical scan start point F of an original, and the transfer sheet P is conveyed to the transfer region D in synchronism with the image formation timing. The toner image formed on the image forming body by an image forming means (to be described later) is then transferred onto the transfer sheet.

The important points herein are to convey the transfer sheet P to the predetermined position D at a low speed of 100 mm/sec or less lower than the sheet feeding speed (e.g., 160 mm/sec) until the sheet P reaches the registration rollers 31, and more preferably at a speed of 5 to 50 mm/sec, to temporarily stop the transfer sheet P conveyed at high speed from the first sheet feeding means 10 at the registration rollers 31 and then convey it to the predetermined position D at low speed (unlike in the prior art wherein a high-speed conveying operation is immediately switched to a low-speed conveying operation to convey the transfer sheet to the predetermined position D), and to control the transfer sheet by arranging not a plurality of sensors but a single sensor after the registration rollers 31.

In this manner, the low-speed conveying operation of the transfer sheet P is performed without stress, and the transfer sheet P can be conveyed at constant speed. When the transfer sheet P is stopped at the predetermined position D, there is no variation in stop position, thus assuring high precision. A convey distance from the registration rollers 31 to the transfer region C is short, and the apparatus can be prevented from becoming bulky, thus reducing cost.

A length $l_3$ between a point E on the image forming body 1, which is subjected to image exposure in response to an optical scan start signal, and the transfer region C is preferably the same as a length $l_2$ between the predetermined position D and the transfer region C. In this case, a conveying speed of the transfer sheet P to the transfer region C is the same as the peripheral velocity of the image forming body 1.

In the speed change device 62 shown in FIG. 7, reference numeral 63 denotes a drive source (motor); 64, a first clutch; 65, a second clutch; 66, a low-speed gear cooperating with the first clutch; 67; a roller shaft gear of the driving roller 33; 68, a high-speed gear cooperating with the second clutch.

Figure 5:
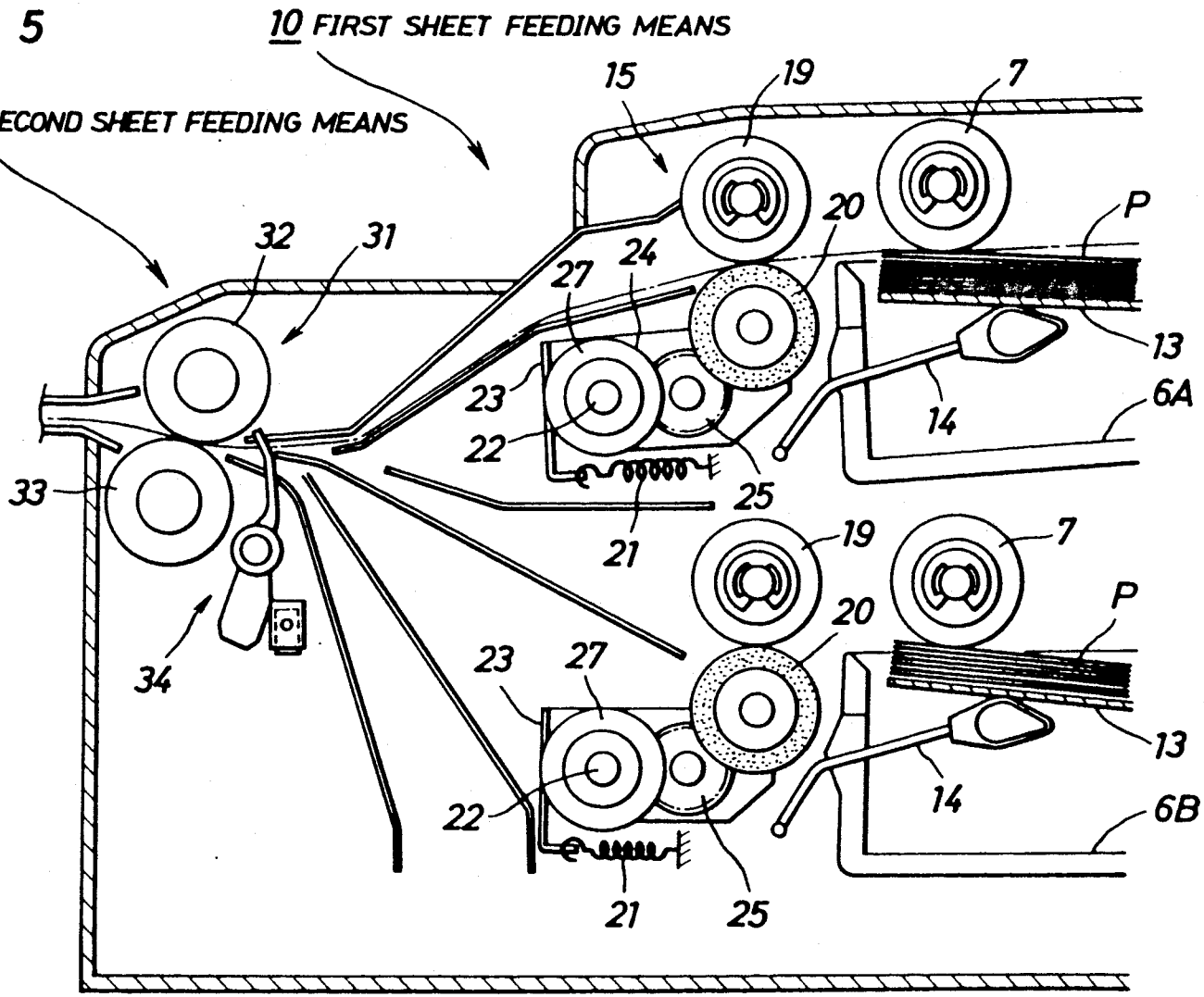
FIG. 5 is a sectional view showing another embodiment of a sheet feeding/conveying mechanism of a transfer sheet in the image forming apparatus of the present invention.

In this embodiment, a pickup clutch (not shown) is engaged under the control of the CPU 60 and the controller 61 using the first sheet feeding means 10 shown in FIG. 5 in response to the copy start signal, so that the pickup roller 7 and the driving roller 19 of the double feeding preventing means 15 are driven at high speed of 190 to 200 mm/sec, thereby feeding conveying 30 A4-size transfer sheets P (longitudinal feeding) per minute. The leading end of each transfer sheet P is detected by the first sensor (infrared photoreceptor) 34 during the conveying operation. The pickup clutch (not shown) is disengaged under the control of the CPU 60 and the like in response to the obtained detection signal, thus stopping the first sheet feeding means 10. The transfer sheet P is conveyed by its inertia for a while (about 0.5 sec) and abuts against the nip portion between the registration rollers 31, thus forming a loop. The transfer sheet P is fitted in and caught by the nip portion by a restoration force of the loop, and its leading end is registered to prevent subsequent skew. Thereafter, the transfer sheet P is conveyed by the second sheet feeding means 30.

The first clutch 64 of the sheet change device 62 is engaged under the control of the CPU 60 and the like 2 seconds ($T_1$) after the leading end of the transfer sheet P is detected by the first sensor 34, so that the transfer sheet P is conveyed for 0.3 sec at low speed of 30 mm/sec (a speed is changed to 1/6 that of the first sheet feeding means 10) and reaches the predetermined position D. The leading end of the transfer sheet P is detected by the second sensor (photosensor) 38, and the first clutch 64 of the speed change device 62 is disengaged under the control of the CPU 60 and the like in response to the detection signal, thus stopping rotation of the registration rollers 31. As a result, the low-speed conveying operation of the transfer sheet P is stopped at the predetermined position D.

The second clutch 65 of the speed change device 62 is engaged in response to a signal from the sensor 39 for detecting a light beam at the optical scan start point F in FIG. 3 through controllers such as the CPU 60 and the like, thereby rotating the registration rollers 31 at high speed. As a result, the transfer sheet P is conveyed at a speed of 180 mm/sec to the transfer region C. A toner image formed on the image forming body is transferred onto the transfer sheet upon operation of the transfer electrode 48.

The transfer sheet on which the toner image is transferred is conveyed by the conveyor belt 49, and the toner image is fixed by the fixing device 50, thus obtaining a copy image. The sheet feeding/conveying timing of the transfer sheet P is as shown in FIG. 8.

Figure 8:
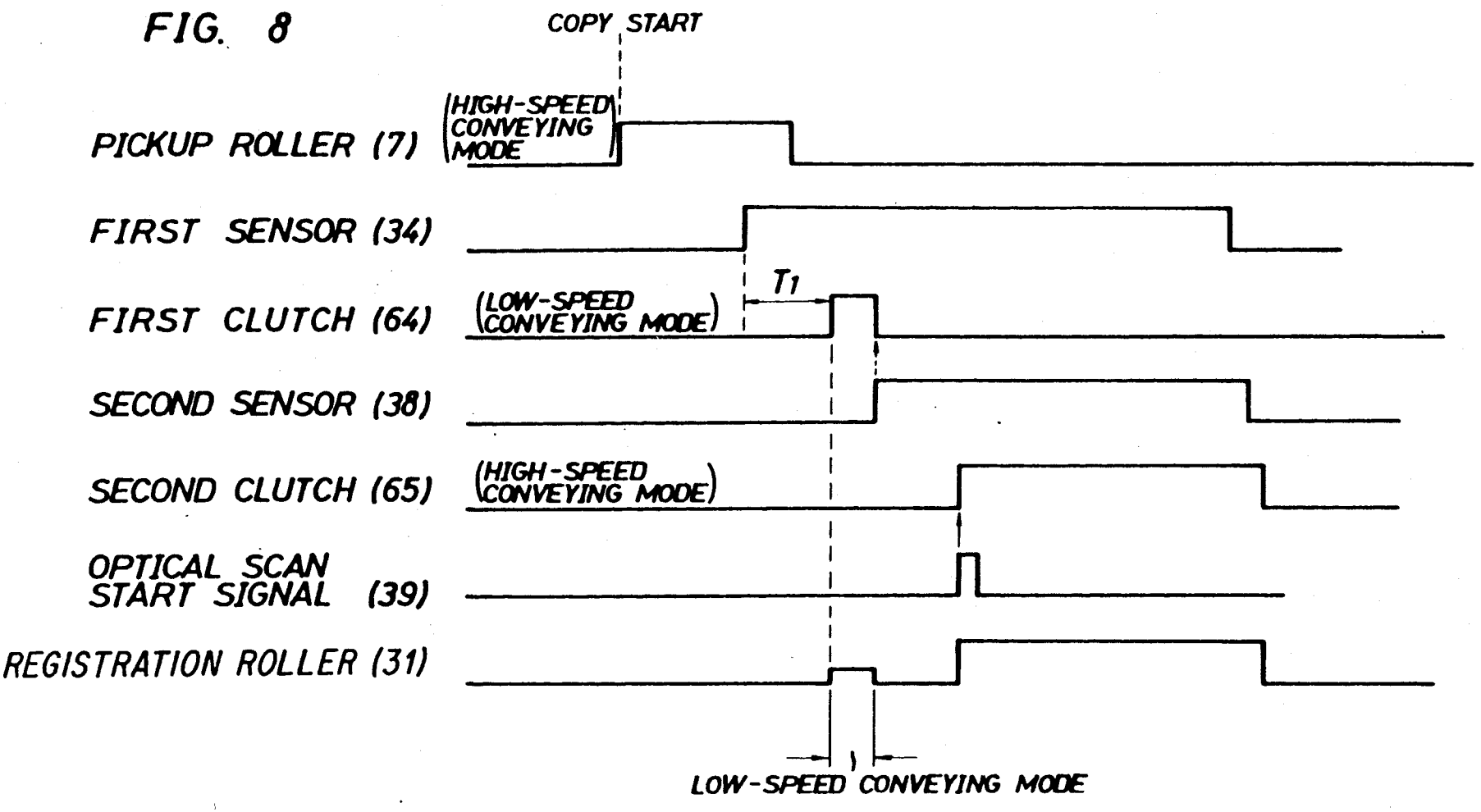
FIG. 8 is a timing chart for explaining an operation of the sheet feeding/conveying mechanism shown in FIG. 3.

As can be seen from FIG. 8, the transfer sheet P is conveyed at high speed by the first sheet feeding means 10. The leading end of the transfer sheet is detected by the first sensor 34 and the transfer sheet is temporarily stopped before the registration rollers 31. The low-speed conveying operation is performed at a predetermined timing from the stopped state, and the transfer sheet is slowly fed and conveyed to the position D as a reference point in synchronism with the image formation timing. The low-speed conveying operation of the transfer sheet is performed at constant speed without being forced, and when the transfer sheet is stopped at the predetermined position D, its positional precision can be satisfactorily assured. The transfer sheet is conveyed from the position D, where the precision is assured, to the transfer region at high speed in response to the optical scan start signal. Therefore, a toner image can be satisfactorily matched on the transfer region, thus obtaining a high-quality copy image.

In the image forming means of this embodiment, the surface of the OPC photosensitive body (image forming body) 1 which is rotated at a peripheral velocity of 180 mm/sec is uniformly charged by the scorotron charger 40. Thereafter, the light beam (exposure beam) L reflected by an original M is exposed on the image forming body to form an electrostatic latent image The latent image is contact-developed by the developing device 47 containing a two-component developing agent consisting of a magnetic carrier and a black toner, thus forming a toner image. The toner image is transferred by the transfer electrode 48 of a corona discharging type onto the transfer sheet conveyed under the above-mentioned conditions. The transferred toner image is heated and fixed by the thermal roller fixing device 50, thus obtaining a copy image. 100 copy images are successively formed by the image forming means. In this case, high-quality copy images free from an offset of timing can be obtained.

Figure 9:
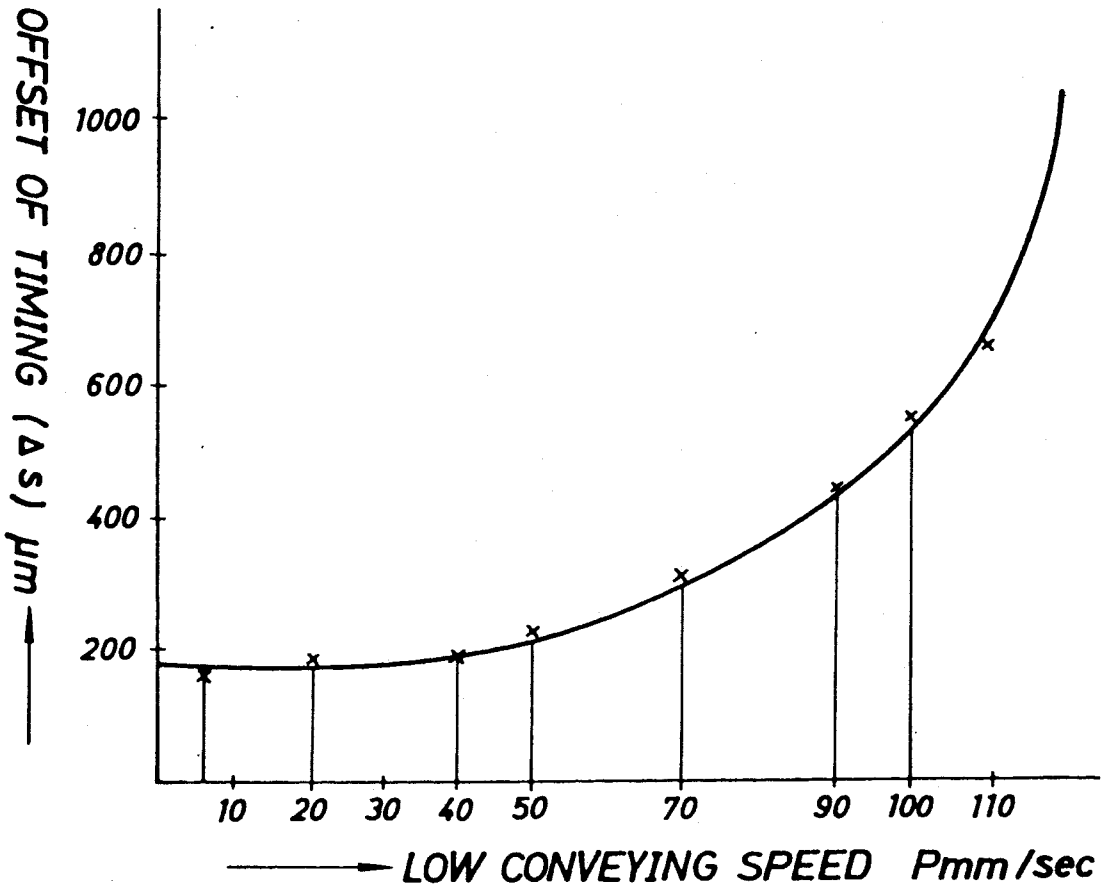
FIG. 9 is a graph showing a relationship between a conveying speed of a transfer sheet and an offset of timing.

In the arrangement of this embodiment, eight low-speed conveying conditions of the transfer sheet P of 5, 20, 40, 50, 70, 90, 100, and 110 mm/sec are set, and 100 copying operations are successively performed for each conveying condition. An offset between the first and 100th copy images is measured. FIG. 9 summarizes the measurement results.

As can be seen from FIG. 9, when a low conveying speed P to the predetermined position D by the registration rollers 31 exceeds 100 mm/sec, an offset $\Delta s$ of timing is undesirably immediately increased. Contrary to this, a range below 50 mm/sec is preferable.

The present invention can be more effectively applied to a sheet feeding/conveying mechanism of a transfer sheet in a color image forming apparatus which repeats a process of transferring and fixing a color toner image formed on an image forming body to form a color image.

A color image forming apparatus as an embodiment of an image forming apparatus according to the present invention will now be described.

Prior to a description of the overall arrangement of the color image forming apparatus, the gist of the present invention will be described below with reference to FIG. 10.

Figure 10A:
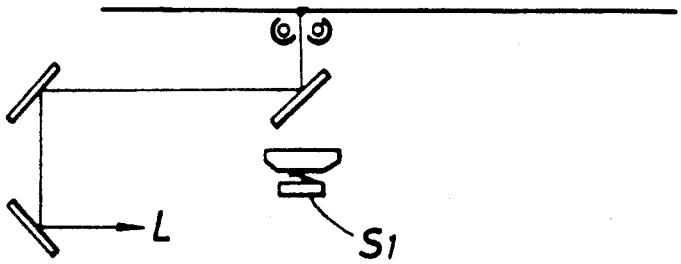
FIG. 10 is a schematic view showing an embodiment of a sheet feeding/conveying mechanism of a transfer sheet in another embodiment of the image forming apparatus according to the present invention.
Figure 10B:
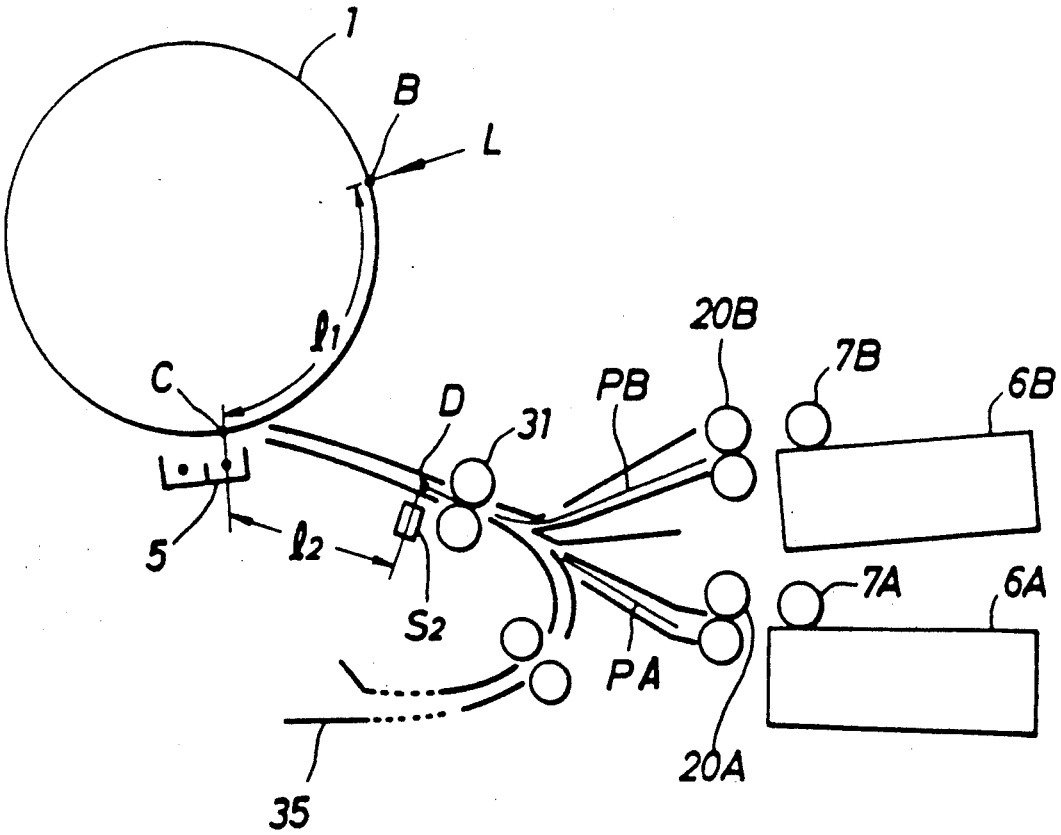

In FIG. 10, a transfer sheet PA or PB is fed from a sheet feed cassette 6A or 6B by driving a pickup roller 7A or 7B in response to a copy start signal. In this case, double feeding of a transfer sheet is prevented by a pair of handling rollers 20A or 20B. The transfer sheet is conveyed to registration rollers 31 which are temporarily stopped.

The leading end of the transfer sheet PA or PB is brought into contact with the registration rollers 31 and is stopped to form a loop. After the lapse of a predetermined period of time, the registration rollers begin to rotate at low speed under the control of a CPU to slowly convey the transfer sheet. The leading end of the transfer sheet is detected by a leading end sensor $S_2$ arranged at a predetermined position D, and the transfer sheet is stopped.

The low-speed conveying operation of the transfer sheet PA or PB is performed at a speed equal to or lower than 100 mm/sec, preferably at a speed of 1 to 80 mm/sec, and more preferably at a speed of 5 to 50 mm/sec. When the low conveying speed exceeds 100 mm/sec like in the conventional apparatus, the transfer sheet slips during the low-speed conveying operation, and is delayed. When the leading end sensor $S_2$ detects the leading end of the transfer sheet and stops the transfer sheet conveyed at low speed at the point D in response to the detection signal, a large inertial force acts, and the transfer sheet cannot be stopped and overruns the point D. As a result, a variation in stop position is increased.

When the transfer sheet is conveyed at low speed as described above, the above problem can be solved, and the transfer sheet can be conveyed while satisfactorily matching with an image formation timing.

In response to a scan start signal from a microswitch $S_1$ of a scan optical system, the registration rollers 31 are driven, so that the transfer sheet is conveyed to a transfer region C at a normal conveying speed.

The operation described above is performed when a transfer sheet is conveyed from the sheet feed cassette 6A or 6B to the transfer region to transfer a first color toner image. After the first color toner image is transferred and fixed, the transfer sheet is circulated, reaches, e.g., an intermediate tray 35, and waits in this tray. In this case, the following conveying operation is performed in the same manner as that from the cassette.

A low-speed conveyed distance of the transfer sheet to the predetermined position D by the registration rollers 31 is normally set to be 1 to 20 mm. After the low-speed conveying operation, a speed at which the transfer sheet is conveyed to the transfer region C is set to be the same as the peripheral velocity of an image forming drum. In this case, a distance between the points D and C is equal to a peripheral length $l_1$ between a write point B to the image forming body and the transfer region C.

In the description of FIG. 10, as an example of the conveying means of the transfer sheet P, after the transfer sheet P conveyed from an immediately preceding process is brought into contact with and stopped at the registration rollers, is conveyed at low speed to and stopped at the predetermined position D, and is then conveyed from this predetermined position as a reference point to the transfer region in synchronism with an image formation timing. With this method, the low-speed conveying operation of the transfer sheet P can be performed at a constant speed without being forced, and the stop operation at the predetermined position P can be accordingly free from variations, thus assuring high precision.

As another example of the conveying means of the transfer sheet P applicable to the present invention, as described in Japanese Patent Laid-Open (Kokai) No. 62-208065, the transfer sheet P conveyed from the immediately preceding process is successively conveyed to a first position by the registration rollers, is conveyed at low speed to a second position without being stopped at the first position, and is then conveyed from the second position as a reference point to the transfer region in synchronism with an image formation timing. Such a means may be employed as the sheet feeding means of the present invention.

A general arrangement and its image formation process of a color image forming apparatus as another embodiment of the present invention will be described below with reference to the block diagram of FIG. 11.

Figure 11:
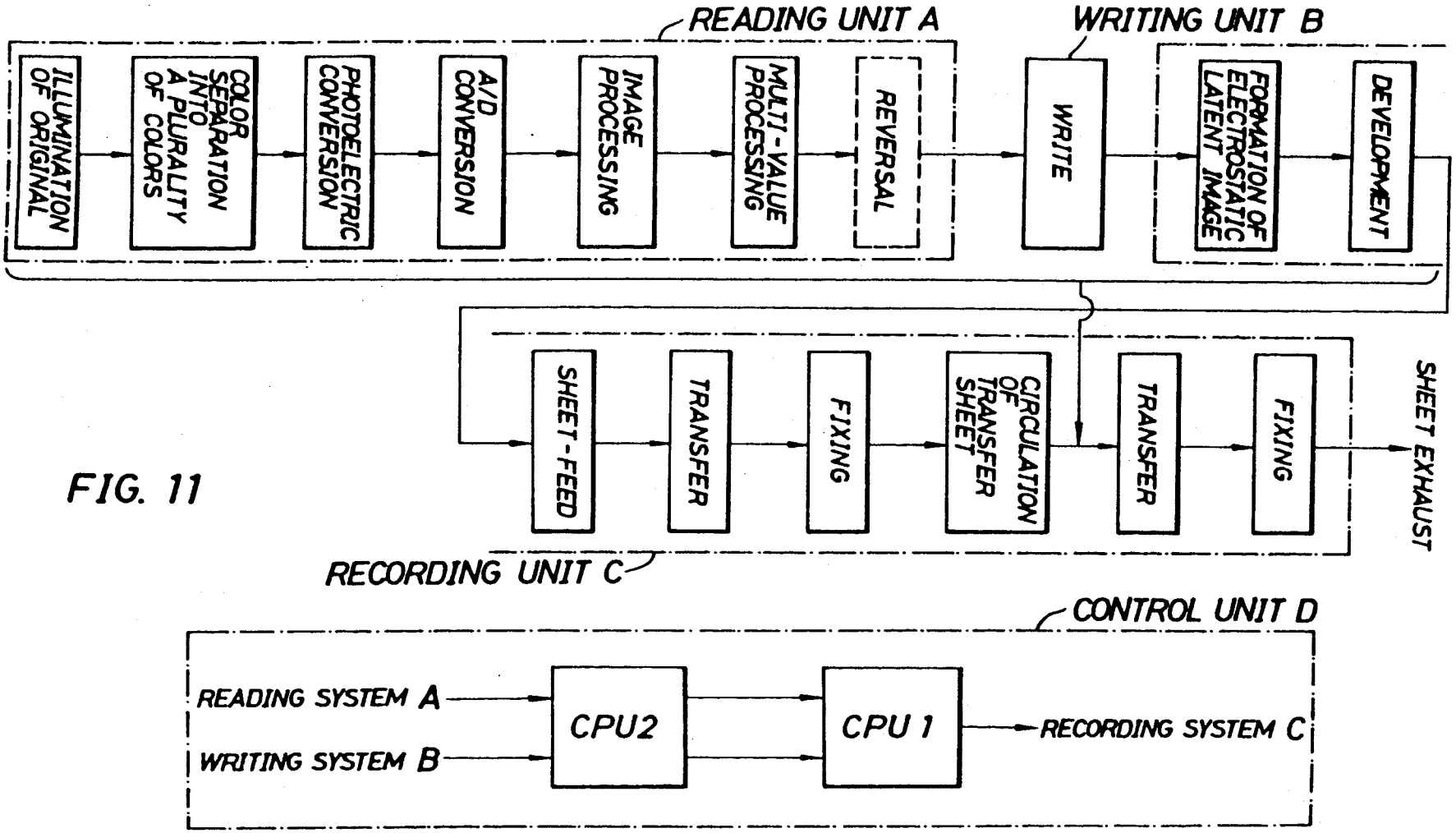
FIG. 11 is a diagram showing a signal processing system of a color image forming apparatus as an embodiment of the image forming apparatus of the present invention.

As shown in FIG. 11, the image forming apparatus of this embodiment comprises a reading unit A, a writing unit B, a recording unit C, and a control unit D. In the reading unit A, optical information obtained by optically scanning a color original with a light source, e.g., a halogen lamp, a fluorescent lamp, or the like is color-separated into a plurality of color components by a color separation means such as a color filter, a dichroic mirror, a dichroic prism, or the like. The plurality of color components are converted to electrical signals by a photoelectric conversion means such as a plurality of line image sensors (to be referred to as CCDs hereinafter). The electrical signals are converted to digital signals by an A/D conversion means. The digital signals in units of colors are converted by an image processor into color signals to be recorded, and are subjected to various correction operations necessary for color recording. The resultant signals are converted to multi-value signals by a multi-value means, thus obtaining recording signals in units of colors.

Each recording signal is output to the writing unit B, and is written on an image forming body by the writing unit B comprising a laser beam optical device, thus forming a corresponding electrostatic latent image. Thereafter, an image formation process is performed by the recording unit C. The recording unit C includes a plurality of developing devices, a sheet feeding mechanism including a transfer sheet circulating/conveying device, a color toner image transferring/separating device, and a cleaning device, and the sheet feeding mechanism is improved to precisely match the sheet feed timing with an image formation timing.

The latent image is developed by a first developing device for storing a color toner developing agent corresponding to the recording signal, thus forming a first color toner image. The color toner image is transferred and fixed onto a transfer sheet which is fed from a sheet feed cassette in synchronism with an image formation timing. Thereafter, the transfer sheet is conveyed by the transfer sheet circulating/conveying means. A second color toner image which is formed on the image forming body by a write access on the basis of the recording signal and development is transferred and fixed onto the first color toner image on the conveyed transfer sheet. This transfer/fixing/circulating process is repeated a necessary number of times, thus forming a color image.

The registration rollers for conveying the transfer sheet employ rollers formed of an elastic material such as urethane rubber, butadiene rubber, or chloroprene rubber having a rubber hardness of 60° to 90° to allow easy catching of the leading end of the transfer sheet and to prevent a slip when the transfer sheet is conveyed.

As a sensor $S_2$ for detecting the leading end of the transfer sheet at a point D, a known sheet detection sensor, e.g., a photosensor, a microswitch, an ultrasonic detector, or the like can be used. As a low-speed conveying mode switching means of the transfer sheet, a known speed change means, such as a speed change motor, a clutch mechanism, a gear switching means, or the like can be used.

In the color image forming apparatus of the present invention, signal processing in the reading unit A in FIG. 11 can employ one described in Japanese Patent Publication No. 59-34306, Japanese Patent Laid-Open (Kokai) Nos. 59-163978 to 59-163980, and Japanese Patent Laid-Open (Kokai) Nos. 62-97467 and 62-230160. Note that in the above description, a color original is used. However, the present invention includes a case wherein a black-and-white original is used, a specific region of the original is designated to perform partial color conversion, and the designated region is developed with a color toner to form a color image.

Figure 12:
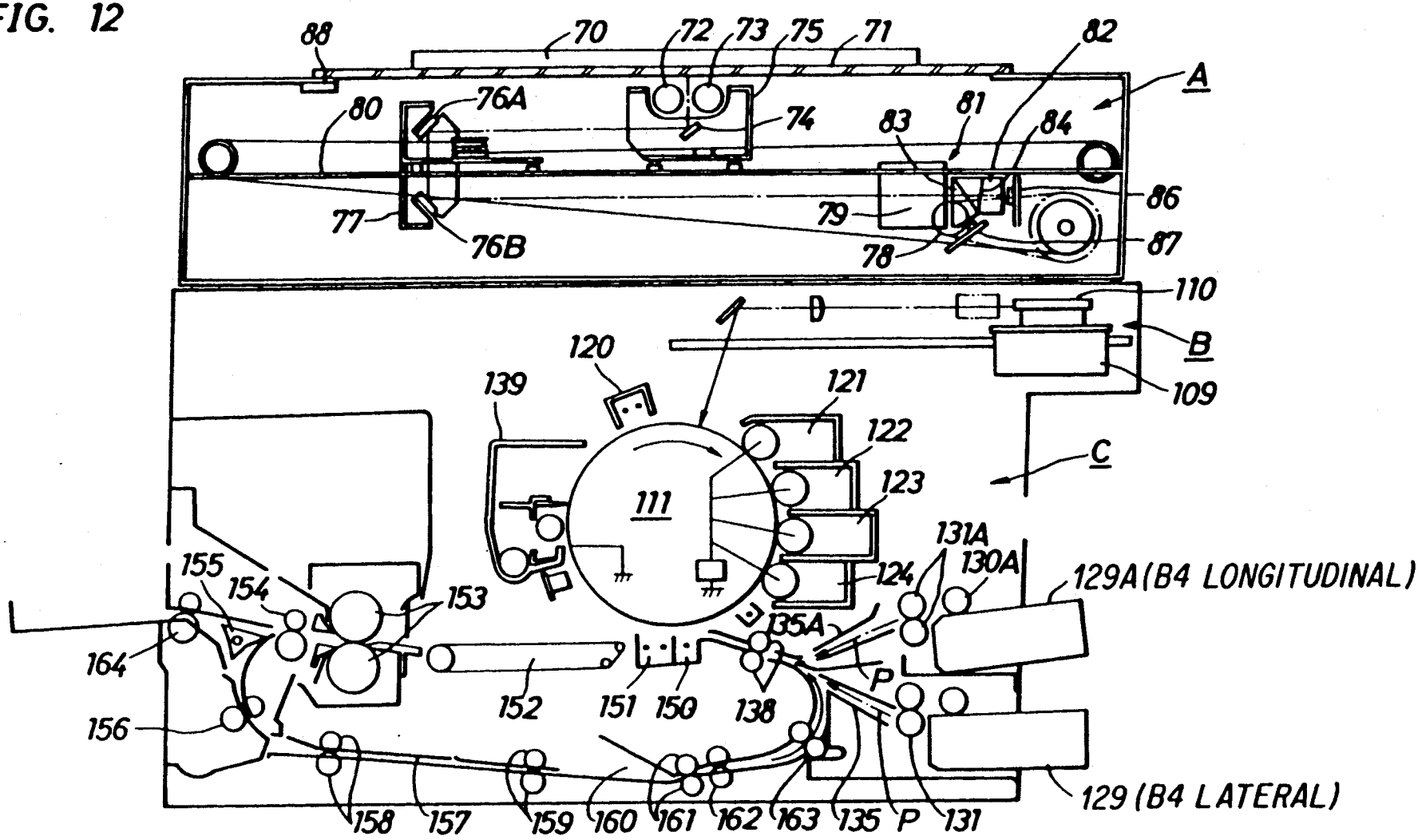
FIG. 12 is a schematic sectional view showing an arrangement of a color image forming apparatus according to the present invention.
Figure 13:
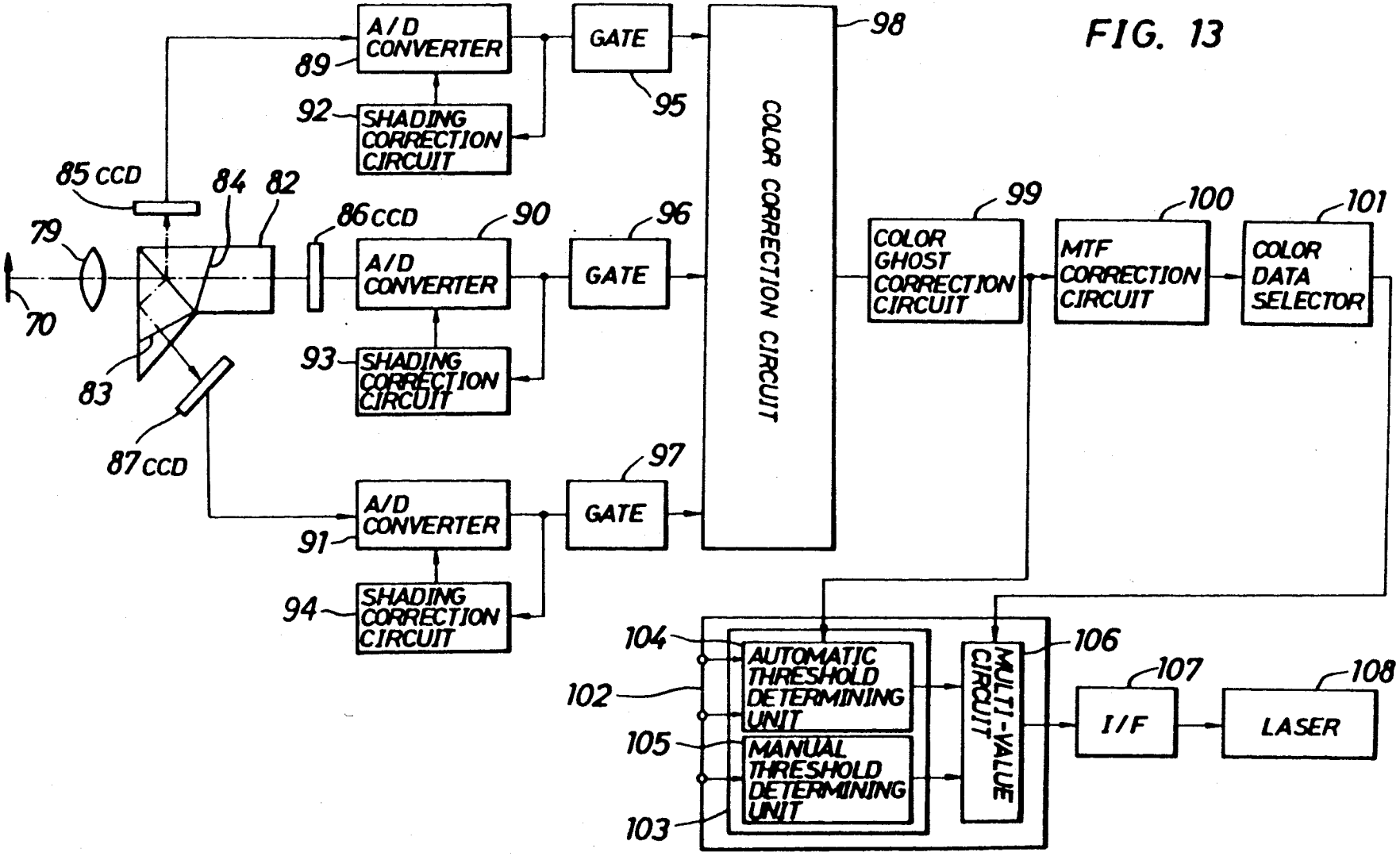
FIG. 13 is a block diagram showing a signal processing system of a reading unit of the color image forming apparatus shown in FIG. 12.
Figure 14:
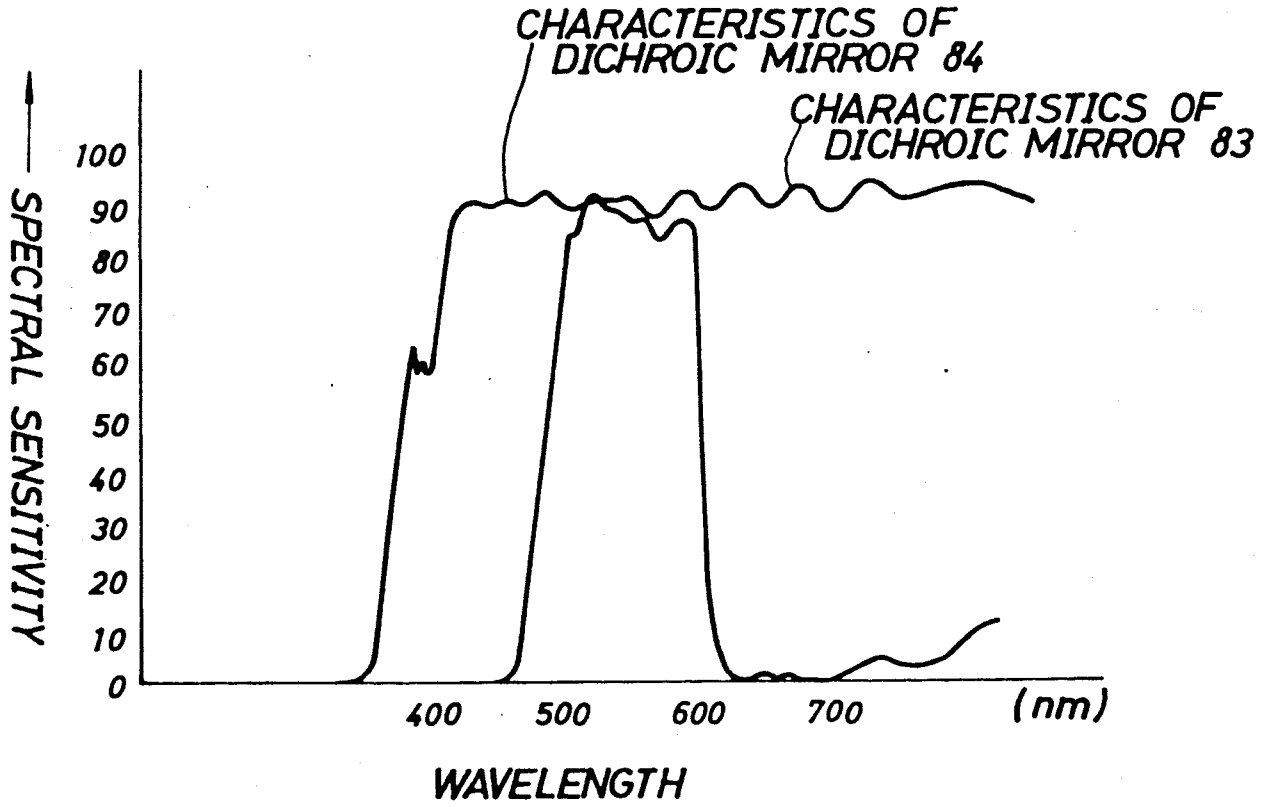
FIG. 14 is a graph showing spectral absorption characteristics of a dichroic mirror used in the color image forming apparatus.
Figure 15:
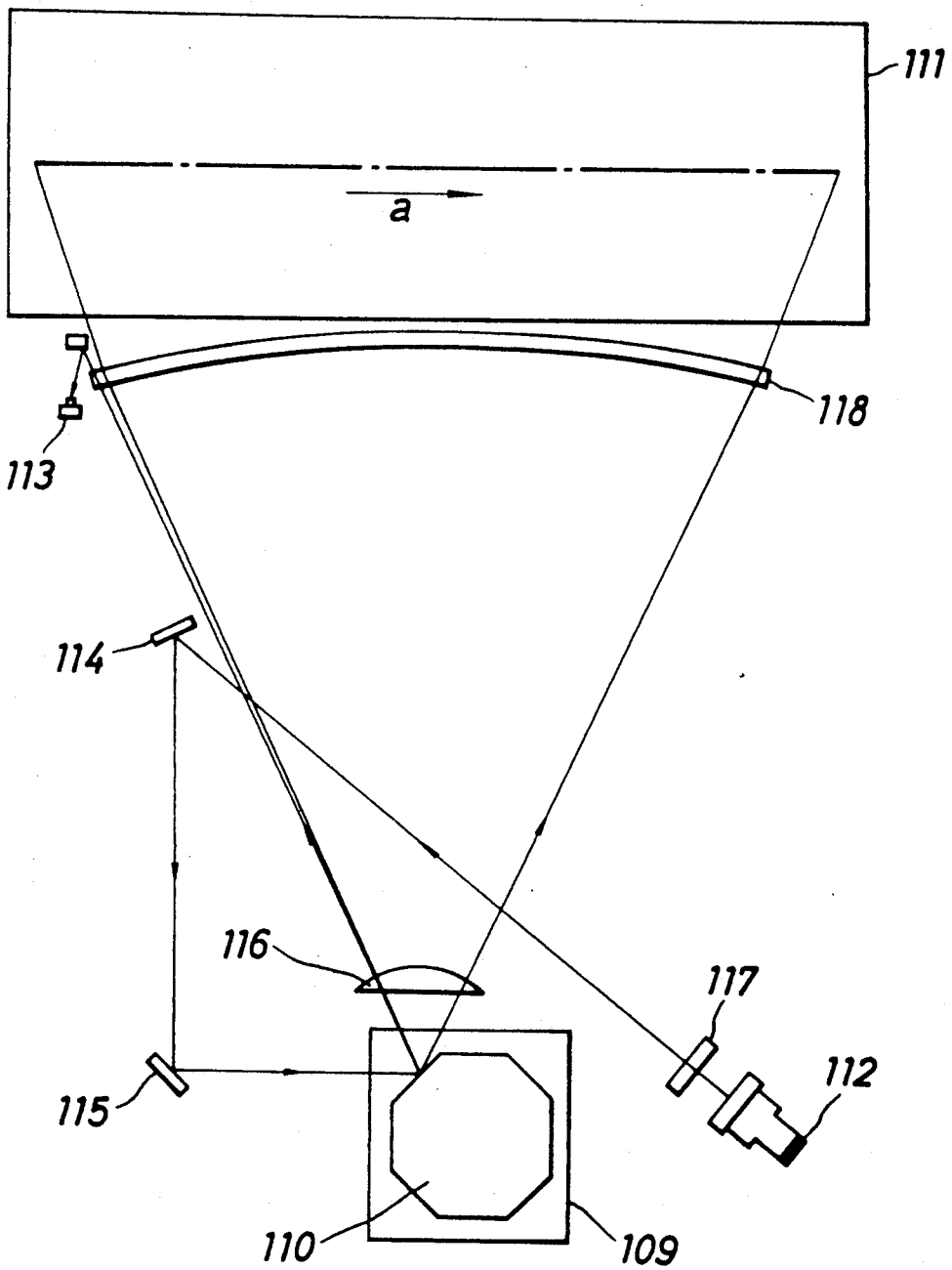
FIG. 15 is a schematic view showing a laser optical device used in the image forming apparatus of the present invention.
Figure 16:
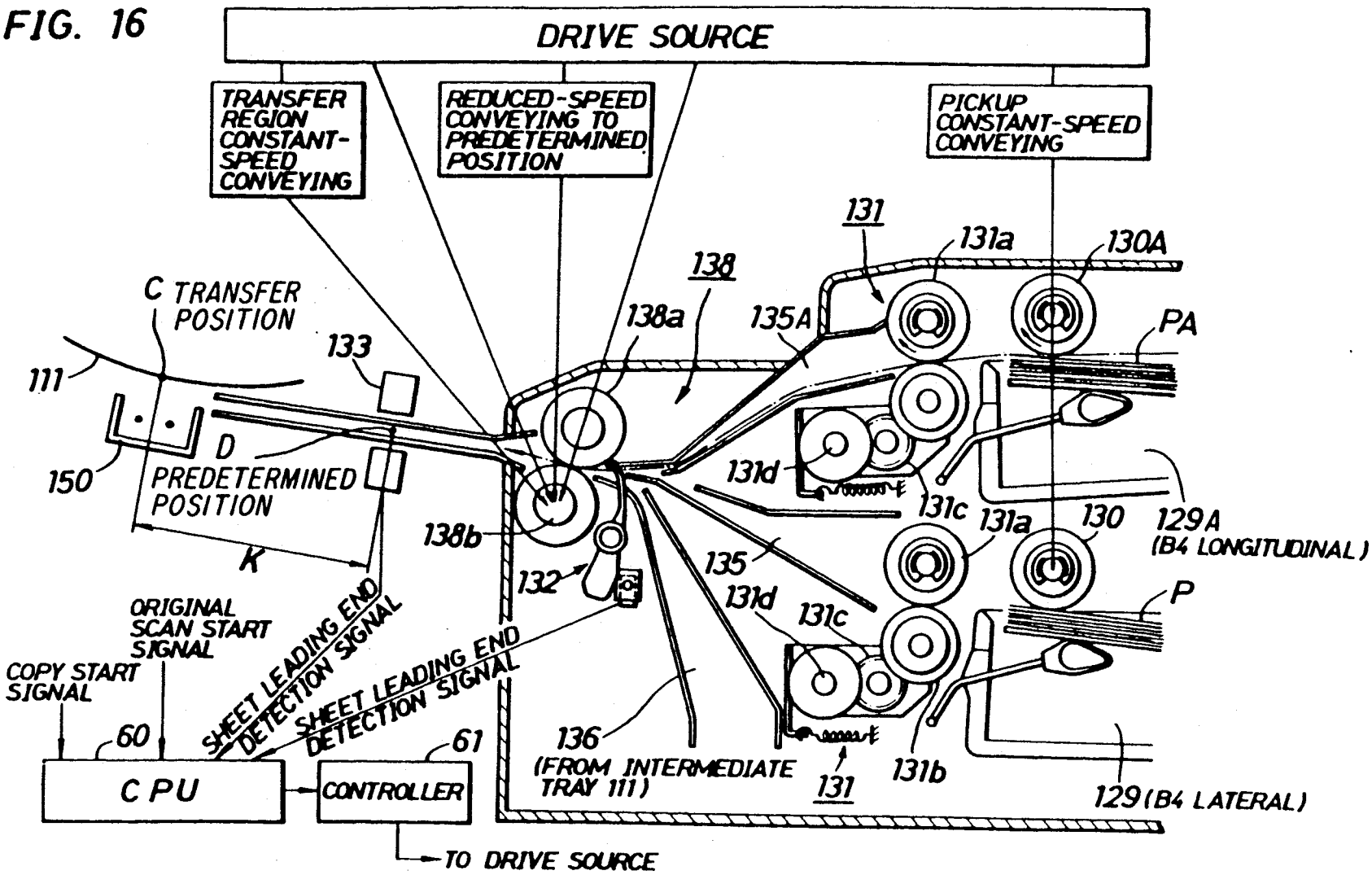
FIG. 16 is a schematic sectional view showing an arrangement of another embodiment of a sheet feeding- /conveying mechanism of a transfer sheet in the image forming apparatus of the present invention.

FIG. 12 is a sectional view of a color image forming apparatus for explaining this embodiment, FIG. 13 is a block diagram for explaining signal processing in the reading unit A, FIG. 14 is a graph for explaining characteristics of a dichroic mirror, FIG. 15 is a sectional view of a laser optical device, and FIG. 16 is a sectional view of the sheet feeding mechanism.

In FIG. 12, a color original 70 on an original table 71 is optically scanned by an optical system. The optical system comprises a carriage 75 provided with light sources 72 and 73 and a reflection mirror 74, and a movable mirror unit 77 provided with V mirrors 76A and 76B. The carriage 75 and the movable mirror unit 77 are caused to travel by a stepping motor 78 along a slide rail 80 at a predetermined speed in a predetermined direction. Optical information (image formation) obtained by irradiating the original 70 with the light sources 72 and 73 is guided to an optical information conversion unit 81 through the reflection mirror 74 and the V mirrors 76A and 76B.

Upon optical scanning of a color original, in order to prevent emphasis or attenuation of a specific color on the basis of optics, the light sources 72 and 73 comprise commercially available warm white fluorescent lamps, and to prevent flickering, the light sources 72 and 73 are turned on and driven by a high-frequency power source of about 40 kHz. The temperature of each lamp is maintained by a heater using a thermistor so as to keep a tube wall at a predetermined temperature or to promote a warming-up operation.

A standard white board 88 is arranged on the rear surface of the left end portion of the original table 71. The standard white board 88 is optically scanned to normalize an image signal to a white signal.

The optical information conversion unit 81 comprises a lens 79, a prism 82, two dichroic mirrors 83 and 84, a CCD 85 for sensing a red color-separated image, a CCD 86 for sensing a green color-separated image, and a CCD 87 for sensing a blue color-separated image.

An optical signal obtained by the optical system is focused by a lens 79, and is color-separated into blue optical information and yellow optical information by the dichroic mirror 83 arranged in the prism 82. The optical signal is further color-separated into yellow optical information and red optical information by the dichroic mirror 84. In this manner, a color optical image is separated into three pieces of color optical information of red R, green G, and blue B by the prism 82.

Each color-separated image is formed on the light-receiving surface of the corresponding CCD, thus obtaining an image signal converted to an electrical signal. The image signals are subjected to signal processing by a signal processing system to obtain recording signals of yellow Y, magenta M, cyan Cy, and black Bk. The recording signals are output to the writing unit B color by color.

The color original reading unit A has been described, and FIG. 13 shows its signal processing system.

As described above, color image information of the color original 70 is color-separated into three color-separated images of red R, green G, and blue B by the two dichroic mirrors 83 and 84. For this purpose, as shown in FIG. 14, the dichroic mirror 83 has a cutoff wavelength of about 450 to 520 nm, and the dichroic mirror 84 has a cutoff wavelength of 550 to 620 nm. Thus, a green component corresponds to transmission light, a blue component corresponds to first reflected light, and a red component corresponds to second reflected light.

Color-separated images of red R, green G, and blue B are supplied to an image reading means, e.g., the CCD sensors 85, 86, and 87. As a result, image signals of red, green, and blue components R, G, and B are output from the CCD sensors, respectively.

The image signals R, G, and B are supplied to A/D converters 89, 90, and 91, and are converted to digital signals each having the predetermined number of bits (8 bits in this embodiment). Simultaneously with A/D conversion, the image signals are subjected to shading correction. Reference numerals 92, 93, and 94 denote shading correction circuits. Each correction circuit corrects a distortion upon image exposure using a white signal obtained by scanning the standard white board 88 as a reference signal in order to correct nonuniformity of an amount of light in a longitudinal direction of the light source lamp.

Signal components having a maximum original size width are extracted from the digital image signals subjected to shading correction by gates 95, 96, and 97, and are supplied to a color correction circuit 98. When a maximum original width to be handled is an A3 size, a size signal A3 generated by a timing signal forming means (not shown) of the system is used as a gate signal.

If the digital signals subjected to shading correction are represented by VR, VG, and VB, respectively, these image signals VR, VG, and VB are supplied to the color correction circuit 98 and are converted to color signals suitable for an image output device.

In this embodiment, colors of the image output device are Y (yellow), M (magenta), C (cyan), and K (black).

Each converted color signal consists of color code data (2-bit data) indicating corresponding color information, and its density data (6-bit data). These color signal data are those stored in a color correction map comprising a ROM.

The color-corrected image data are then supplied to the color image processing step.

The color code data is supplied to a color ghost correction circuit 99, and is subjected to color-ghost correction using $7\times1$ pixels in the main scan direction (horizontal scan direction) and $1\times7$ pixels in the sub-scan direction (drum rotating direction).

Such a correction is performed since an unnecessary color ghost is produced particularly around a black character during color correction. A red or blue color may appear at an edge portion of a black character depending on the format of the color correction map. The color ghost is removed to improve image quality. The color ghost processing is performed for only the color code data.

Reference numeral 100 denotes an MTF correction circuit for performing resolution correction. Since the resolution correction is edge correction, image data to be subjected to processing is density data.

A color data selector 101 receives a processing designation signal for designating image processing to be performed from a display/operation unit and Y, M, Cy, and Bk signals indicating presently sensed colors to be output, and selects based on the above-mentioned input signals whether or not density data subjected to resolution correction is to be output to a multi-value means 102.

For example, when a copying operation is merely performed, images having the same colors as the Y, M, Cy, and Bk signals are output. When a color change operation is performed for the entire original, i.e., when magenta is changed to cyan and cyan is changed to magenta, magenta image data is output when cyan is recorded, and when cyan image data is output when magenta is recorded.

Image data (density data) output from the color data selector 101 is converted to multi-value data by the multi-value means 102. In this embodiment, 6-bit density data is converted to 2-bit data (four-value data) of 0 to 3. Threshold value data (6 bits) as a reference for four-value conversion is manually or automatically set.

For this purpose, a threshold value selector 103 comprises a manual threshold determining means 105 for manual selection and an automatic threshold determining means 104 for automatic selection. The manual threshold determining means 105 is arranged to independently determine threshold values in units of colors, and outputs an externally designated threshold value. Image data is binarized using this threshold value.

The automatic threshold determining means 104 comprises a ROM storing predetermined threshold values. Manual and automatic selection modes are switched by an EE canceling signal. Normally, the automatic selection mode (EE mode) is set. Y, M, Cy, and Bk signals indicating a current sequence and color to be selected are supplied.

Four-value image data output from the multi-value means circuit 106 is output to the writing unit B through an interface 107. The signal processing system of the reading unit A described above is described in detail in Japanese Patent Application No. 63-16413 entitled "Color Image Processing System" by the present applicant. The writing unit B comprises a semiconductor laser device 108 shown in FIG. 15. A laser beam from the laser device is modulated by the four-value recording signals from the reading unit A to be converted to predetermined light signals, and these signals are written on a photosensitive body (image forming body) 111.

The semiconductor laser device 108 has a laser oscillator 112. A laser beam emitted from the oscillator 112 is incident on a deflector 110 comprising, e.g., a rotary polygonal mirror through mirrors 114 and 115. The laser beam is deflected by the polygonal mirror, and is radiated on the surface of the photosensitive body 111 through a focusing f-$\theta$ lens 116.

Reference numerals 117 and 118 denote cylindrical lenses for correcting a tilt angle.

A laser beam scans, in a predetermined direction a, the surface of the photosensitive body 111 by the deflector (polygonal mirror) 110 rotated by a drive motor 109 at a constant speed. With this scan, image exposure corresponding to recording signals in units of colors can be made.

The f-$\theta$ lens 116 is used for reducing the beam spot size on the photosensitive body 111 to a predetermined diameter.

The deflector 110 may comprise a galvano mirror, an optical quartz deflector, and the like. When deflection scan with the laser beam is started, beam scan is detected by a laser beam index sensor 113, and beam modulation by the first color recording signal (yellow signal) is started. The modulated beam scans the surface of the photosensitive body 111 uniformly charged by a charger 120.

An electrostatic latent image corresponding to the first color signal Y is formed on the photosensitive body 111 by main scan of the laser beam and subscan of rotation of the photosensitive body 111.

The latent image is contact-reversal developed by a first developing device 121 for storing a yellow developing agent (to be described later) to form a yellow toner image. The toner image is transferred onto a transfer sheet P which is conveyed in synchronism with an image formation timing by a sheet feeding method of FIG. 16 (to be described later), upon operation of a transfer electrode 150.

The photosensitive body 110 comprises a negative-charging OPC photosensitive body (to be described later), and a developing agent containing a negative-charging yellow toner is used. Therefore, a DC bias voltage of $-500$ to $-600$ V is applied from a bias power supply to perform contact-reversal development, and as a result, a portion exposed with the laser beam spot on the basis of the Y recording signal is developed.

The yellow toner image transferred onto the transfer sheet P in this manner is separated from the photosensitive body upon operation of a separation electrode 151, and is conveyed to a fixing device 153 by a conveyor belt 152. The toner image on the transfer sheet is heated and fixed by the fixing device. The transfer sheet P after the fixing operation is conveyed by conveying rollers 154 under the control of a flipper 155, and is then conveyed by conveying rollers 156 to be fed into a circulating path 157. In the circulating path 157, the transfer sheet is fed into and held in an intermediate tray 160 through conveying rollers 158 and 159 to wait for the next operation. On the other hand, the photosensitive body 111 after the transfer operation of the yellow toner image is cleaned by a cleaning device 139, recharged by the charger 120, subjected to beam scan on the basis of a second color recording signal (magenta signal) obtained by the reading unit A, and developed by a second developing device 122 for storing a magenta developing agent. Thus, a magenta toner image is formed on the photosensitive body 111. The transfer sheet P waiting in the intermediate tray 160 is conveyed from, the intermediate tray 160 to registration rollers 138 by conveying rollers 161, 162, and 163 in response to a sheet feed signal from a CPU. Thereafter, the transfer sheet is conveyed to the transfer region in synchronism with an image formation timing by the sheet feeding method of FIG. 16 (to be described later) as in the sheet conveying operation from a cassette 129. The magenta toner image is transferred onto the transfer sheet upon operation of the transfer electrode 150, and is then fixed.

In the similar process, write access on the basis of a third recording signal (cyan signal), development using a third developing device 123 (cyan developing device), write access on the basis of a fourth recording signal (black signal), and development using a fourth developing device 124 (black developing device) are repeated. As a result, the corresponding color images are overlaid on the transfer sheet P, thus obtaining a color image. The transfer sheet P carrying the color image is exhausted onto an exhaust tray through exhaust rollers 164 under the control of the flipper 155.

Of the four developing devices, one, two, or three developing devices may be operated to form a single-color two-color, three-color image.

When a large number of copies are formed based on a single original, transfer sheets P on which an yellow toner image is formed are stacked in the intermediate tray 160. When a magenta toner image is transferred, the transfer sheets P on which the yellow toner image is formed are picked up and conveyed one by one from the lowermost sheet in synchronism with the image formation timing and the magenta toner image is transferred and fixed on each transfer sheet. This process is also repeated for cyan and black toner images. Thus, a large number of color image copies can be efficiently formed.

In this embodiment, a lateral-feed B5 normal paper sheet is used as the transfer sheet P. In order to convey the transfer sheet P, a sheet feeding mechanism shown in FIG. 16 is used. More specifically, the transfer sheet P is conveyed from the sheet feed cassette 129 or the intermediate tray 160 to the registration rollers 138 through a path 135 or 136 by a double feeding preventing means 131 constituted by a pickup roller 130, a driving roller 131*a*, a handling roller 131*b*, an idler 131*c*, and a limiter 131*d* or the conveying rollers 161 to 163 at a conveying speed of 150 mm/sec on the basis of a sheet feed signal from the CPU. A sheet leading end detector (photointerrupter using an infrared ray) 132 is arranged near the registration rollers 138 to detect the leading end of the conveyed transfer sheet P. In response to the detection signal from the sensor, the pickup roller 130 and the driving roller 131*a* of the double feeding preventing means 131 are stopped to have a time lag of 0.1 sec so that the transfer sheet P is brought into contact with the surfaces of the registration rollers 138. In this case, since the stop operation of the pickup roller 130 and the driving roller 131*a* is delayed, a loop is formed at the leading end portion of the transfer sheet P. Driving and driven rollers 138*b* and 138*a* of the registration rollers 138 are rotated at low speed under the control of the CPU to convey the transfer sheet P, whose leading end is registered by the sheet pressure of the loop, at a conveying speed of 60 mm/sec by 9 mm. As a result, the leading end of the transfer sheet P reaches a point D. The transfer sheet is stopped at the point D as follows. That is, the leading end of the transfer sheet P is detected by a photosensor 133, and the drive operation of a drive source is stopped in response to the detection signal.

The driving roller 138*b* is driven by a signal $S_1$ from a scan start point (point A in FIG. 10) of an original scan optical system, and the transfer sheet is conveyed to a transfer region at a speed of 200 mm/sec (equal to the peripheral velocity of the photosensitive body 111).

Note that a distance K between the predetermined position D and the transfer position C is set to be the same as a peripheral length of the photosensitive body 111 extending from the write start point B to the body 111 to the transfer position C as in FIG. 11.

When the transfer sheet P after the transfer and fixing operations of a toner image is circulated, it is conveyed to the conveying rollers 156 at a speed of 200 mm/sec after the transfer and fixing operations. Thereafter, the transfer sheet is conveyed at high speed of 300 mm/sec to the intermediate tray 160. The transfer sheet is conveyed from the intermediate tray 160 at a speed of 150 mm/sec in the same manner as in sheet feeding from the sheet feed cassette 129.

A speed in respective sheet feeding processes is changed by switching gears and clutches under the control of the CPU.

In this embodiment, an effect of conveying the transfer sheet P at low speed between the registration rollers 138 and the predetermined position D is particularly enhanced in an image forming apparatus in which a transfer sheet P carrying a fixed toner image is circulated like in this embodiment. More specifically, although flexibility of a paper sheet is decreased by fixing and its conveying property is degraded, a transfer sheet can be conveyed to and stopped at the predetermined position D without causing bending, skew, slip, and the like. As a result, conveyance to the next transfer region can be precisely achieved. Misregistration of colors of a resultant color image can be eliminated as much as possible, thus obtaining a high-resolution color image.

A B4-size transfer sheet is fed from a sheet feed cassette 129A (B4 longitudinal) in place of the sheet feed cassette 129 (B5 lateral) to form a color image. In this case, the transfer sheet PA on the sheet feed cassette 129A is conveyed at a speed of 150 mm/sec by a pickup roller 130A and conveying rollers 131A (also serving as a double feeding preventing means) via a conveying path 135A, and is brought into contact with the registration rollers 138. The sheet forms a loop under the control of the sheet leading end detection signal, and is stopped. Thereafter, a low conveying speed from the registration rollers 138 to the predetermined position is set to be 40 mm/sec, and a conveying speed from the predetermined position D is set to be 202 mm/sec slightly higher than the peripheral velocity of 200 mm/sec of the photosensitive body. Since a B4-size sheet must be fed longitudinally, its size is large. Therefore, the conveying speeds are set to prevent a conveying operation from being delayed to delay a transfer timing.

Other parameters are set in the same manner as in the above embodiment, and a high-resolution color image free from color misregistration can be obtained.

What we claim is:

1. An image forming apparatus in which a latent image is formed on a rotatable image forming body and a toner image is obtained by developing the latent image and is transferred to a transfer material, said apparatus comprising:

feeding means for feeding transfer material at a first predetermined speed;

double feeding preventing means for preventing more than one transfer material from being fed at the same time;

a pair of registration rollers;

feed controlling means for stopping the feeding of transfer material by the feeding means when a leading end of the transfer material abuts a nip portion of said pair of registration rollers; and conveying controlling means for controlling said registration rollers by rotating said registration rollers after said feed controlling means stops the feeding of said transfer material to convey the transfer material to a predetermined position at a second predetermined speed lower than said first predetermined speed and then rotating said registration rollers to convey the transfer material from the predetermined position to a transfer position at a third predetermined speed higher than said second predetermined speed, the third predetermined speed being in synchronism with the speed of the image forming body.

2. The apparatus of claim 1, wherein said double feeding preventing means comprises a roller, and a handling belt which is urged against said roller, so that the transfer material passes between said roller and said handling belt.

3. The apparatus of claim 1, wherein said feed controlling means comprises means for detecting a leading end of a transfer material, said detecting means positioned at an upstream side of said registration rollers, and means for stopping said feeding means after a predetermined time period in response to an output from said detecting means.

4. The apparatus of claim 1, wherein said second predetermined speed is not more than 100 mm/sec.

5. The apparatus of claim 1, wherein said second predetermined speed falls within a range of 5 to 50 mm/sec.

6. The apparatus of claim 1, wherein said image forming apparatus is a color image forming apparatus in which color original information is read to form a latent image in each desired color on the image forming body, the latent images are developed in each desired color, and resultant color toner images are transferred onto a transfer material in each desired color to form a multicolor image on said transfer material.

7. The apparatus of claim 6, further comprising means for circulating the transfer material on which the color toner image is transferred.

8. The apparatus of claim 1, wherein said feed controlling means includes delay means for stopping the feeding of transfer material by the feeding means a predetermined time after a leading end of the transfer material abuts a nip portion of said pair of registration rollers.

9. The apparatus of claim 1, further comprising a sensor between the registration rollers and the transfer position, the sensor generating a signal indicating the detection of the transfer material and the rotation of the registration rollers being capable of being stopped in response to the signal from the sensor.

* * * * *